United States Patent [19]

MacDonald et al.

[11] Patent Number: 4,686,533

[45] Date of Patent: Aug. 11, 1987

[54] OPTOELECTRONICALLY SWITCHED PHASE SHIFTER FOR RADAR AND SATELLITE PHASED ARRAY ANTENNAS

[75] Inventors: Robert I. MacDonald; Elmer H. Hara; Arthur L. Poirier, all of Ottawa, Canada

[73] Assignee: Her Majesty the Queen in right of Canada, as represented by the Minister of National Defence of Her Majesty's Canadian Government, Ottawa, Canada

[21] Appl. No.: 524,780

[22] Filed: Aug. 19, 1983

[30] Foreign Application Priority Data

Jan. 31, 1983 [CA] Canada ..... 420580

[51] Int. Cl.[4] ..... H01Q 3/22

[52] U.S. Cl. ..... 342/373; 342/371

[58] Field of Search ..... 343/373, 374, 9 PS, 343/371, 372

[56] References Cited

U.S. PATENT DOCUMENTS 3,307,188 2/1967 Marchetti et al. ..... 343/372

4,028,702 6/1977 Levine ..... 343/374

OTHER PUBLICATIONS

Levine, Arnold; Use of Fiber Optic Frequency and Phase Determining Elements In Radar; May 30–Jun. 1, 1979.

*Primary Examiner*—Theodore M. Blum

*Assistant Examiner*—Gregory C. Issing

*Attorney, Agent, or Firm*—Cushman, Darby & Cushman

[57] ABSTRACT

This invention utilizes an opto-electronic matrix switch to select a set of fixed value phase shifters. Signals which are selectively phase shifted by this apparatus may be introduced into the signal path of each antenna element of a phased array antenna. In one embodiment the input signal is converted into an intensity modulated optical signal which is then split between paths of different length to provide different delays and hence different phase shifts. The matrix then selects a particular set of the phase shifted signals which are converted back to electrical signals and fed to the antenna array elements.

12 Claims, 6 Drawing Figures

OPTOELECTRONICALLY SWITCHED PHASE SHIFTER FOR RADAR AND SATELLITE PHASED ARRAY ANTENNAS

BACKGROUND OF THE INVENTION

This invention relates to an improved apparatus for introducing phase delays to a signal. The invention has application in introducing phase delays to the antenna elements of a phased array antenna and has particular application in radar and communication satellite applications of a phased array antenna.

For various types of electrical apparatus it is necessary to introduce phase shifts in a signal. For instance, in establishing the transission beam pattern of a phased array antenna, it is necessary to deliver the signal to each antenna element with a particular phase delay, referred to an arbitrary standard phase. If a beam pattern similar to the transmission beam pattern is required for reception, a particular phase delay similar to that introduced for transmission must be introduced to the signals received by each antenna element before the received signals are combined.

Where a signal is carried on several lines and it is necessary to phase shift the signal on each line with respect to the other signals, it is usual to have a phase control unit associated with each line. For example, Hannan, in Canadian Pat. No. 1,023,847, issued Jan. 3, 1978 discloses a phase control unit associated with each radiating antenna element of a phased array antenna. Such phase control units may produce continuous or incremental phase shifts; as these units require electronic components they are usually the most expensive part of a phase control system.

It is an object of the present invention to provide a phase control system which is inexpensive when compared with the expense of associating variable control units with each of several signal carrying lines.

For certain applications it is known to connect a matrix between the input and output lines in order to phase shift the signal frequency on the output lines. In operation, a known set of phase shifted signals is selected by applying the input signal to the appropriate input port. Only by applying the signal to different input ports are different "routes" through the matrix selected, and consequently, different phase shifts chosen. See for example Canadian Pat. No. 1,027,670 by Kadak, issued Mar. 3, 1978, in which such a matrix is associated with a phased array antenna.

In order for a phase selecting matrix to operate satisfactorily for certain applications, such as beam steering applications in connection with Time Division Multiple Access (TDMA) communication satellites and certain radar, the matrix must have the following characteristics: frequency response in excess of 1 GHz, switching time of less than 10 ns., transmission band width in excess of 500 MHz, isolation of more than 80 dB and cross talk levels. at least 65 dB below the signal level. The prior art matrices do not have these characteristics.

It is a feature of the present invention to provide a phase selecting switching matrix with these characteristics.

In phased array antenna apparatus it is necessary to supply some device as an "on-off" switch for transmission and reception.

It is a further feature of this invention to utilize the fast switching characteristics of the opto-electronic switching matrix as a transmission or reception gating ("on-off") switch in addition to its use as a phase selector.

The invention relates to apparatus for selecting a set of phase-shifted components of an electrical signal comprising: a plurality of phase shifting means; first signal conveying means coupled to each of the phase shifting means; a plurality of opto-electric transducers arranged in an array; second signal conveying means coupling each phase shifting means to each opto-electric transducer in a corresponding row of the array; and a plurality of lines each connected to the opto-electric transducers in a column of the array whereby the opto-electric transducers when enabled couple signals between the phase shifting means to the lines to provide the set of phase-shifted components.

In another aspect, the invention relates to apparatus for selecting a set of phase-shifted components of an electrical signal comprising: a plurality of signal delay means; first signal conveying means coupling the signal to each of the signal delay means; a plurality of opto-electric transducers arranged in an array; second signal conveying means coupling the output of each signal delay means to each opto-electric transducer in a corresponding row of the array; and a plurality of output lines each connected to the opto-electric transducers in a column of the array whereby the opto-electric transducers when enabled coupled signals from the outputs of the delay lines to the output lines to provide the set of phase-shifted components on the output lines In another aspect, the invention relates to apparatus for selecting a set of phase-shifted components of an electrical signal comprising: an optical modulator responsive to the electrical signal to provide an intensity modulated optical signal; a plurality of opto-electric transducers arranged in an array; a plurality of optical paths of varying length extending between the output of each modulator and a respective row of opto-electric transducers in the array; and a plurality of output lines each connected to a column of the transducers in the array, whereby the output lines are selectively energized with the set of phase-shifted components.

In yet another aspect, the invention relates to apparatus for selecting a set of phase-shifted components of an electrical signal comprising: a plurality of delay lines adapted to receive the signal; a plurality of optical modulators, one connected at the output of each delay line; a plurality of opto-electric transducers arranged in an array; a plurality of optical paths of equal length extending between each optical modulator and a row of tranducers in the array; and a plurality of output lines each connected to a column of the transducers in the array, whereby the output lines are selectively energized with the set of phase-shifted components.

DETAILED DESCRIPTION OF THE PREFERRED EMBODIMENTS

Figure 1:
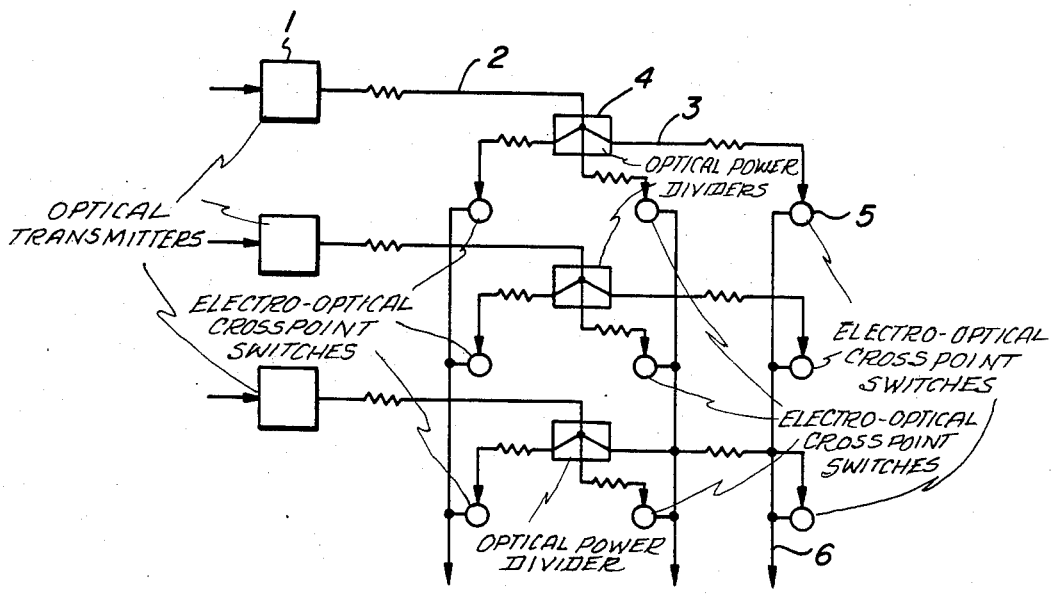
FIG. 1 illustrates an opto-electronic switching matrix.

In FIG. 1 an electrical input signal is converted by an optical transmitter 1 to an optical signal by means of impressing the electrical signal as intensity modulation on an optical carrier. The optical signal is conducted to an optical power divider 4 by an optical signal path 2, for example an optical fiber waveguide. An advantage of this technique is the very high isolation that can be obtained between the optical signal paths even when they are constrained to a small physical volume. The power divider 4 distributes the optical signal, by further optical signal paths 3, to an opto-electronic crosspoint switch 5. The crosspoint 5 is a photodetector which when enabled converts the optical intensity modulated signal back to an electrical signal on an outgoing line 6. An array or matrix is formed by repeating these elements so that the input lines can be selectively coupled to output lines 6. Each opto-electronic switch may be under the control of an electronic computer by circuits well known to those familiar with the art.

Figure 2:
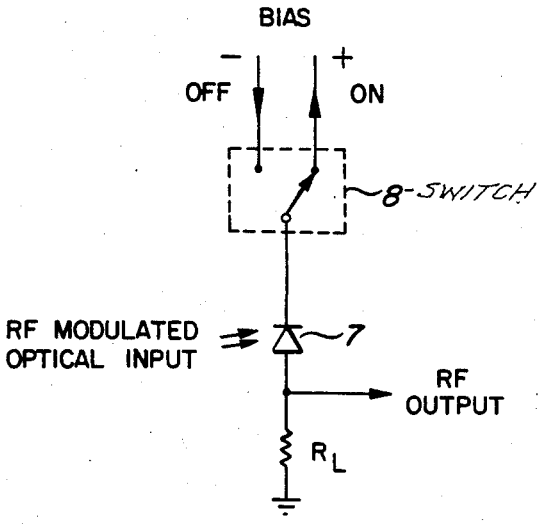
FIG. 2 illustrates a crosspoint of an opto-electronic switching matrix.

The crosspoint switch 5 used in such a matrix is shown in FIG. 2. In order to achieve the switching function the photosensitivity of a photodetector 7 is altered by means of an electrical control signal from an optically sensitive on-state to an insensitive off-state. The photodetector 7 may be a photodiode which is turned "on" by reverse biasing and turned "off" by forward biasing. The bias is switched electronically by an electronic switch, represented at 8 in FIG. 2. Alternatively, the photodetector 7 may be GaAs photoconductive device such as a GaAs photoconductive detector, in which case the on-state is established by applying a drain voltage of less than 10 volts, and the off-state by applying a zero bias condition. With the GaAs photoconductive detector, switching times of less than 5 ns. have been measured. In addition, frequency response in excess of 1 GHz, transmission bandwidth in excess of 500 MHz and high isolation are possible.

Figure 3:
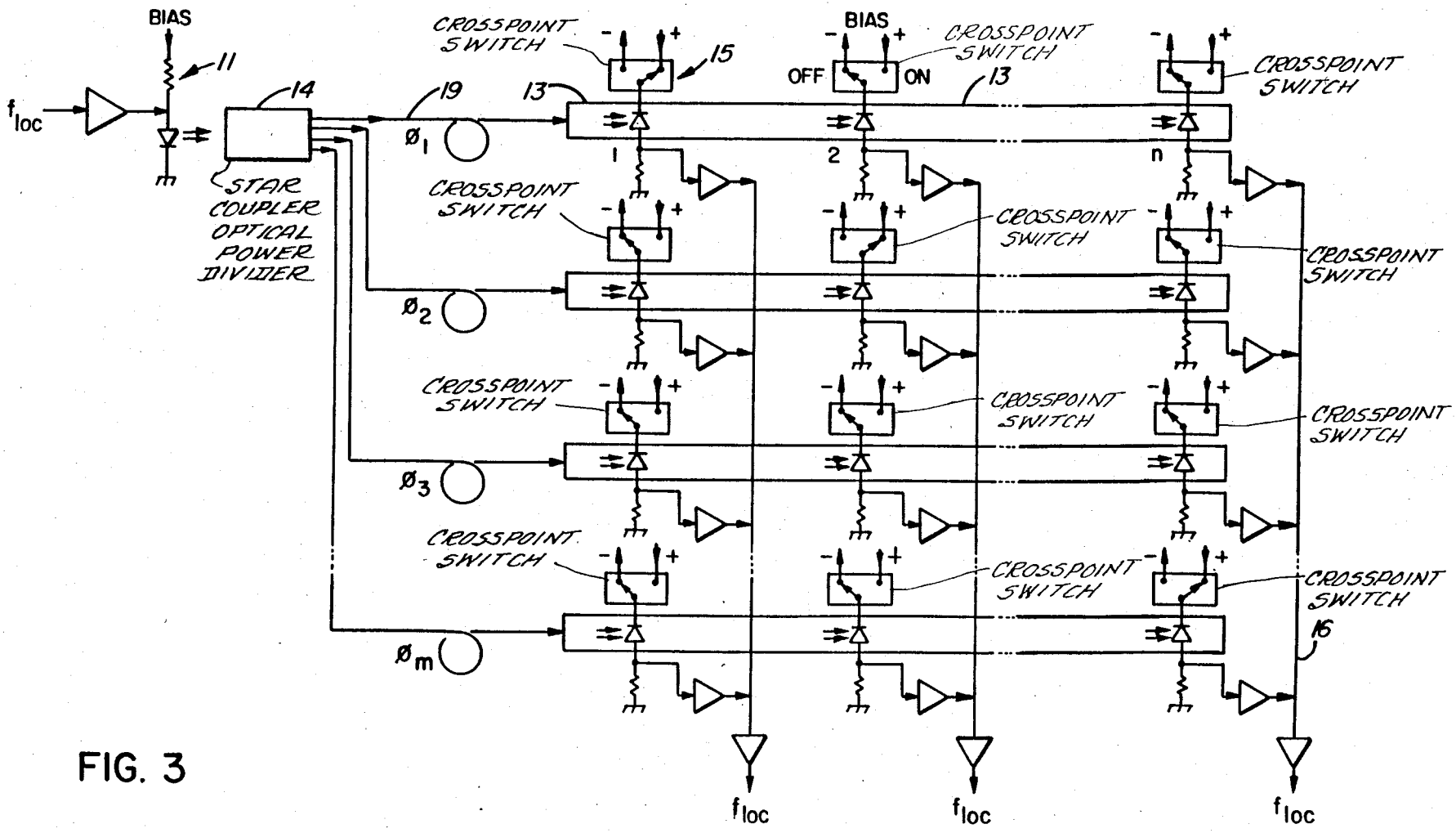
FIG. 3 is a schematic drawing of an optical phase-shifter associated with an opto-electronic switching matrix.
Figure 4:
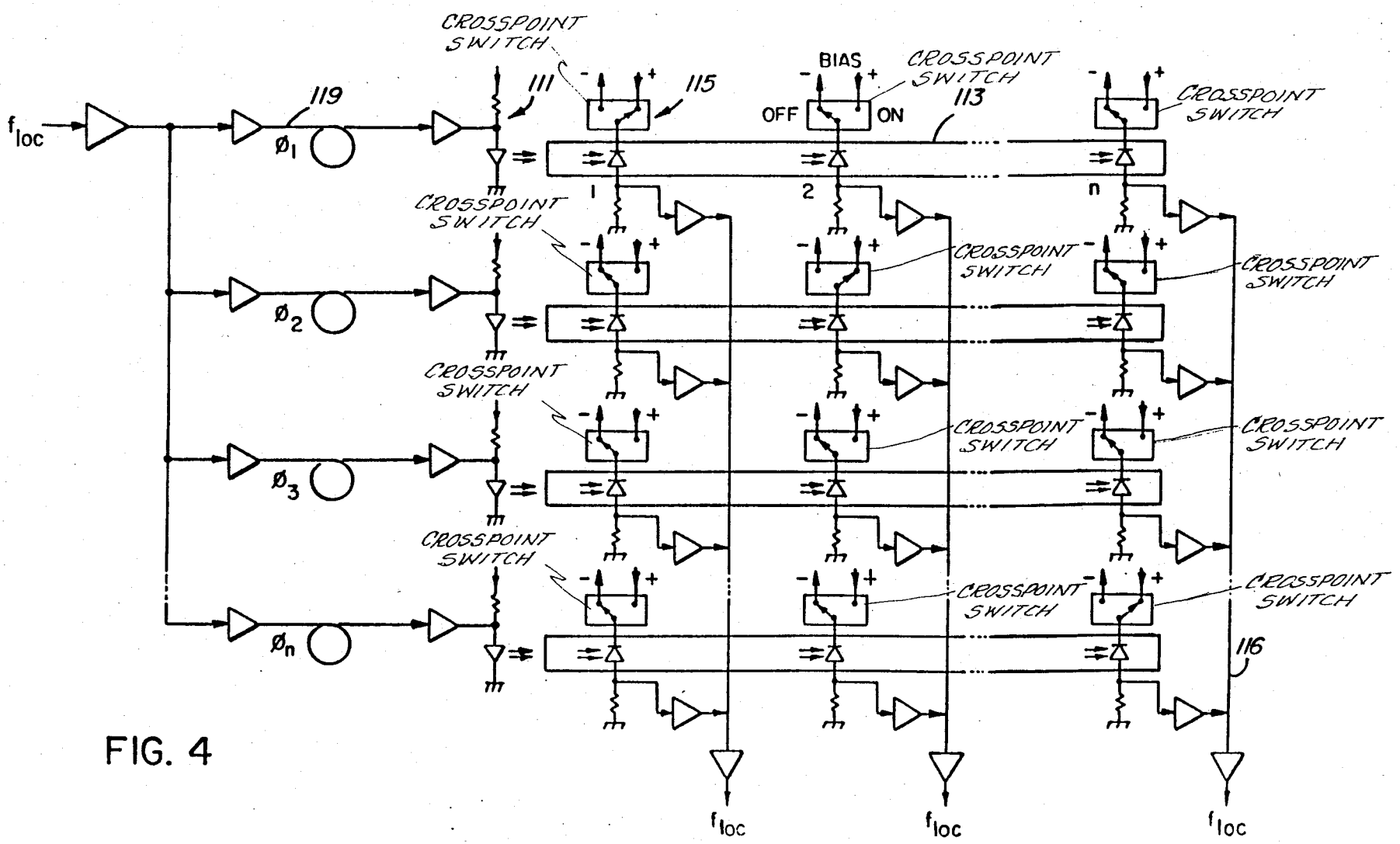
FIG. 4 is a schematic drawing of an electrical phase-shifter associated with an opto-electronic switching matrix.

FIGS. 3 and 4 show two forms of opto-electronic switching matrices capable of altering the relative phase-shift of the signals. The incoming RF electrical signal $f_{loc}$ in FIG. 3 is converted by an optical transmitter 11 to an intensity modulated optical signal. The modulated optical output is coupled into a star coupler optical power divider 14 which distributes power equally to optical signal paths 19 which are of differing length. Because of the differing delays in optical signal paths 19, the signals are given different phase shifts. The phase shifted signals are then fed to crosspoint switches 15. In order to preserve the relative phase-shifts introduced by the delay lines, the optical distribution system is constructed so that each optical path length 13 from the end of a delay lines 19 to each crosspoint switch 15 is equal. Such an optical distribution system can be constructed by using a star coupler and equal lengths of optical fiber for the signal paths 13. By turning selected crosspoint switches 15 "on" a set of phase-shifted electrical signals appears on outgoing lines 16.

As shown in FIG. 3, the apparatus may have "m" phase-shifters and "n" crosspoint switches associated with each phase-shifter; the apparatus would then have "n" output lines. By choosing "m", the number of different phase-shifts available is decided; by choosing "n", the number of combinations of sets of these phase-shifts which may be chosen is determined.

In FIG. 4 the delay lines 119 are electrical rather than optical. The delay lines 119 feed into optical transmitters 111 which distribute the resultant phase-shifted signals to the appropriate crosspoint switches 115 by equal length optical signal paths 113. As before, by energizing appropriate crosspoint switches 115 a set of phase-shifted signals can be made to appear on outgoing lines 116.

Although electrical and optical delay lines have been illustrated as the phase-shifting means, it should be clear to those skilled in the art that any other discrete phase-shifting means may be employed.

Figure 5:
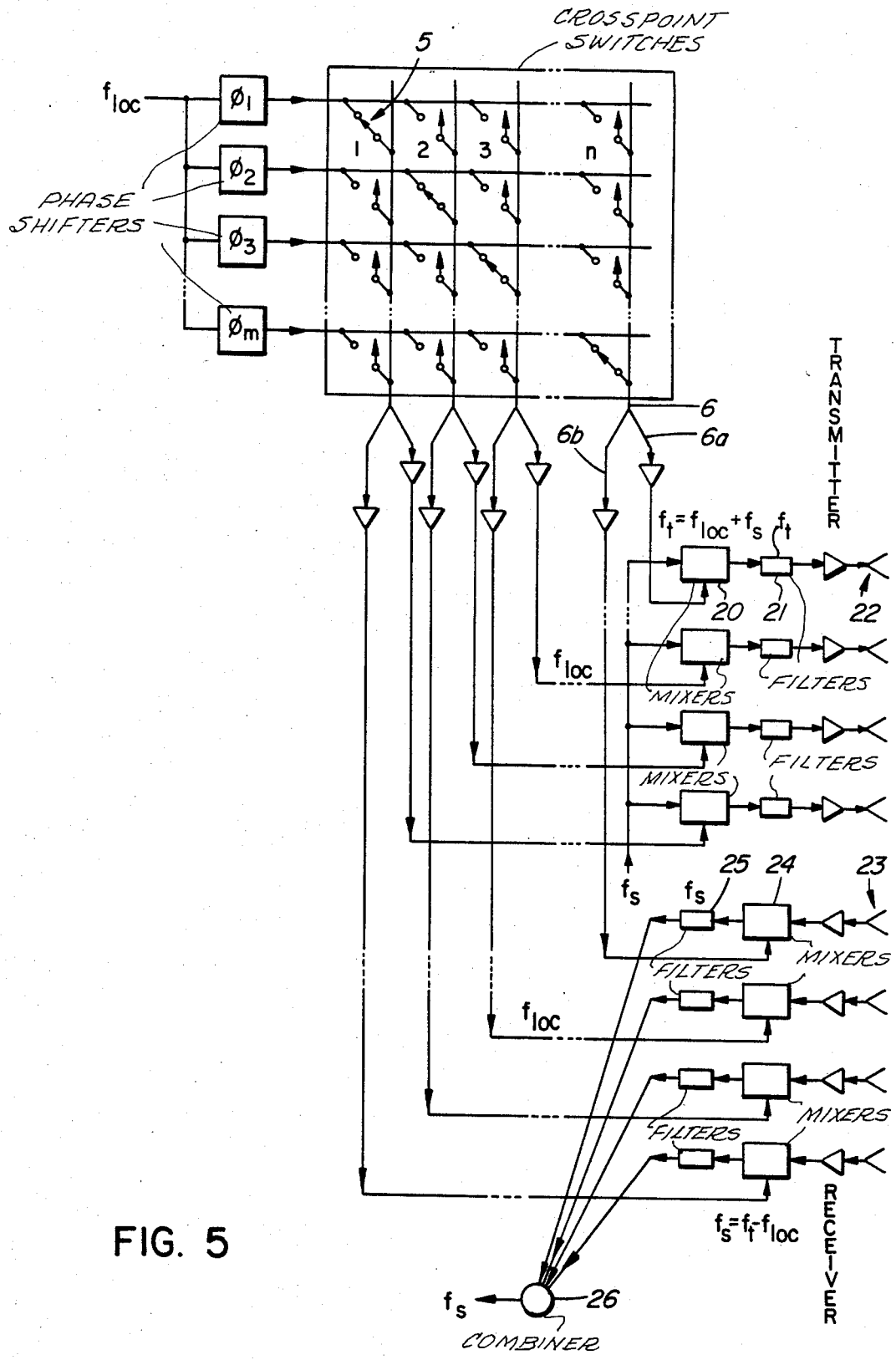
FIG. 5 illustrates the operation of the opto-electronically switched phase-shifter with a phase array antenna for use as a radar.

The apparatus of FIGS. 3 and 4 may be associated with a phased array antenna. In FIG. 5 the apparatus is illustrated associated with a phase array antenna for use in a radar system. In the transmitter, and RF signal, $f_{loc}$, is divided into m signals; each signal is then phase-shifted and each particular phase-shifted component is transmitted to "n" crosspoint switches 5. One crosspoint switch is turned "on" at each outgoing lines 6. The set of phase-shifted signals is applied, through outgoing lines 6*a*, to a set of mixers 20 that mixes a second RF signal, $f_s$, with the $f_{loc}$ signals. The sum frequencies, $f_t=f_{loc}+f_2$, pass through filters 21 and are then supplied to the antenna array elements 22. The direction of transmission is determined by the set of phase-shifts selected by the switching matrix. In the operation of the illustrative embodiment, the signal $f_s$ is in the form of short bursts of a sinusoidal wave train which has the appearance of a radar-frequency signal that is modulated by a rectangular wave when viewed on an oscilloscope.

In order to receive signals from the same direction as the direction of transmission, the signals, $f_t$, received by the receive antenna array elements 23, are fed to mixers 24 with the same set of phase-shifted signals $f_{loc}$ as was used for transmission. This phase-shifted set of $f_{loc}$ is supplied to the mixers 24 through outgoing lines 6*b*. The mixing produces difference signals $f_s=f_t-f_{loc}$ which signals are filtered in filters 25 and summed in the combiner 26 to give the desired signal $f_s$.

Since the crosspoint switches 5 can switch in less than 10 ns. the direction of transmission, and therefore reception, can be altered rapidly. Further, the direction of transmission and reception can be made to differ by selecting a different set of phase-shifts for $f_{loc}$ during reception.

In another embodiment for the radar system two independent switching matrices may be employed. One phase selecting opto-electronic matrix is associated with the transmitter and another with the receiver. In all other respects the apparatus is as has been hereinfore described. If an independent matrix is associated with the receiver, a set of phase-shifts of the signal $f_{loc}$ may be selected by the Receiver switching matrix which is different from the set selected by the Transmitter matrix. Consequently, the direction of reception may be selected independently of the direction of transmission.

In both embodiments, as is well known in the art, the resolution of the antenna array may be varied by, for example, varying the number of radiating elements in use. Thus, in operation, a transmission may be made over a wide angle and reception may initially be in the same direction, with the same resolution, then, if a reflected signal is received, the resolution of the Receive antenna array may be increased and the direction of reception may be switched between each pulse of the signal frequency $f_s$ is order to precisely and rapidly detect the azimuth and elevation of the target.

Figure 6:
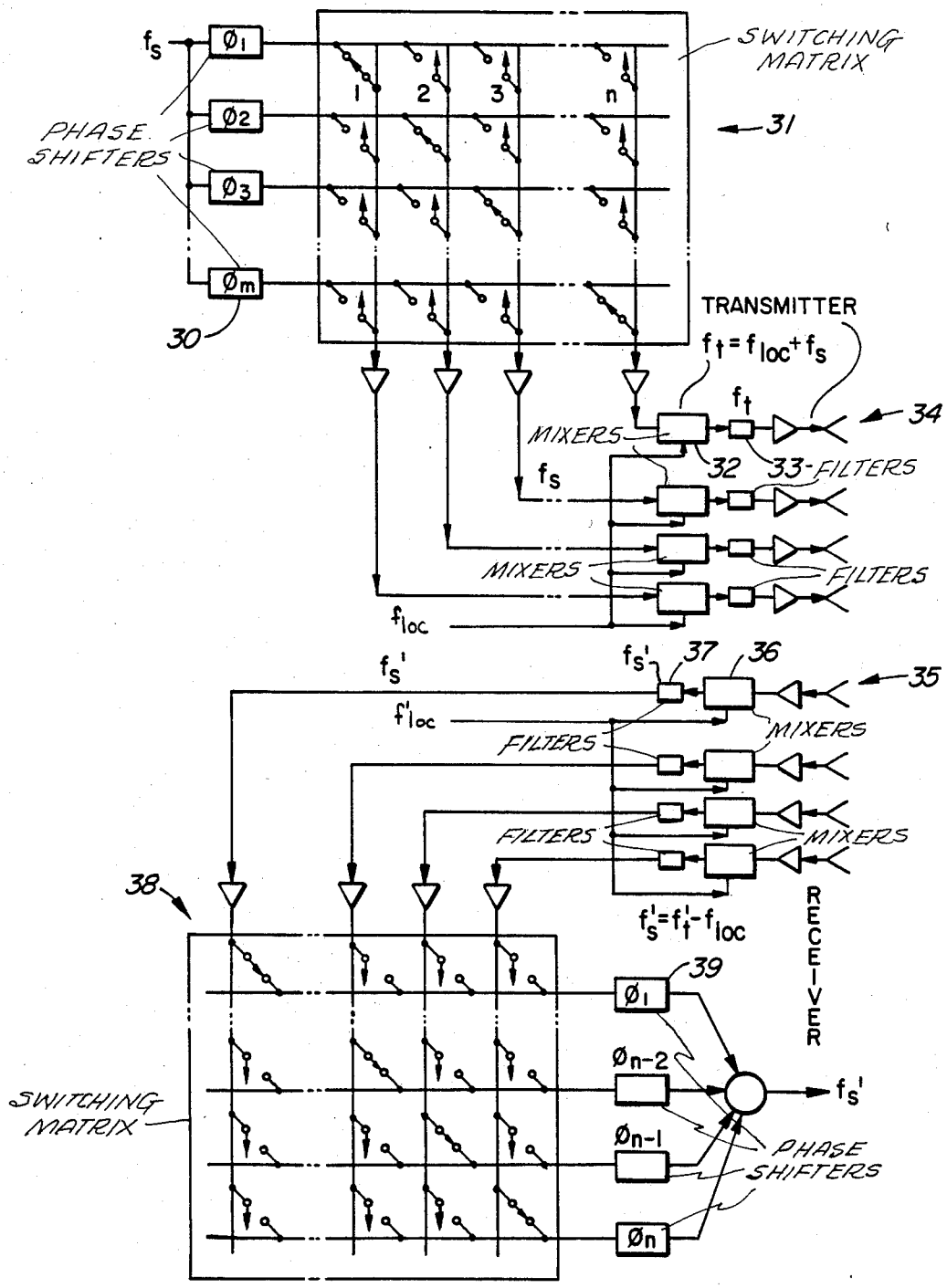
FIG. 6 illustrates the operation of an opto-electronically switched phase-shifter with a phase array antenna for use in TDMA satellite communications.

In the preceding description an RF signal, $f_{loc}$, was phase-shifted to obtain the desired directivity for the transmitter and receiver antennas. As an alternate approach, the second RF signal, $f_s$, which is in the form of short bursts, can be phase shifted before transmission and after reception to obtain the desired directivity for the transmitter and receive antennas. FIG. 6 illustrates this alternate approach. The RF signal, $f_s$, is divided into m signals and each signal is phase-shifted by the phase shifters 30. The appropriate set of phase-shifted signals for the desired direction of transmission is selected by the switching matrix 31 and supplied to the set of mixers 32. The sum frequencies, $f_t=f_{loc}+f_s$, are then supplied to the array of transmitting antennas 34.

The directivity of the receiver antenna is determined by phase-shifting the RF signals $f_s'=f_t'-f_{loc}$ by using a switching matrix 38 which selects the appropriate phase-shifters 39 for a receiver antenna element to obtain the desired direction. Here, the signal $f_t'$ is the signal received by the receiver antenna. The signals emerging from the phase-shifters 39 are summed to produce the final signal $f_s'$. The phase-shifters 39 may consist of optical delay lines having a light source, an appropriate length of fiber and a photo-detector, or alternatively consist of electrical delay lines. In the case of phase array radar applications, the frequencies $f_s$ and $f_s'$ are equal, which means that the frequencies $f_t$ and $f_t'$ are equal as well.

In another embodiment, the apparatus may be associated with a phased array antenna for use in satellite communications, and especially, for time division multiple access (TDMA) satellite communications. FIG. 6 illustrates such an application. The transmitter and receiver are associated with the satellite. In operation, the signal frequency, $f_s$, from the ilustrated transmitter is phase-shifted by discrete phase-shifters 30. A set of phase-shifted signals is selected by the opto-electronic switching matrix 31. The set of phase-shifted signals of $f_s$ is fed to mixers 32 along with another signal, $f_{loc}$. The resultant signal, $f_t$, is fed through filters 33 to the transmit antenna array 34. The direction of transmission is determined by the set of phase-shifts introduced by the switching matrix 31.

Signals received by the receive antenna array 35 are mixed with the signal $f'_{loc}$ in mixers 36 to produce difference signals $f'_s=f'_t-f'_{loc}$. These signals pass through filters 37 to an opto-electronic switching matrix 38 with associated phase-shifters 39 in order to allow independent selection of the direction of reception for the receive antenna array 35. The outputs from the selected phase-shifters are summed to obtain the final signal $f'_s$.

In satellite communications the uplink and downlink transmission frequency normally differ, thus independent local oscillators are provided in the transmitter and receiver to produce $f_{loc}$ and $f'_{loc}$, respectively.

In order to accomplish time division multiplexing, each ground station is allocated a time slot within which to transmit information to the satellite. Thus, given, for example, five ground stations, A–F, the satellite receiver circuitry will, during the time a signal is expected from ground station A, select such phase-shift by means of the opto-electronic switching matrix 38 to apply to the incoming frequency-shifted signal $f'_s$ so as to be able to receive the signal $f_t'$ from the direction of ground station A. At the conclusion of the time allocated for ground station A's transmission, the satellite's circuitry will switch the direction of reception in order to be able to receive a signal from a second ground station, for example, ground station B, and so on. The steps can be repeated to receive signals from each ground station in any order. In communication satellites using time division multiplexing the time slots allocated to each ground station are short—in the order of ms. Since the opto-electronic switching matrix can be switched rapidly, e.g. 10 ns the time division multiplexing, as well as the beam steering, can be performed by the matrix. This is accomplished by choosing the appropriate time of activation of chosen crosspoint switches in addition to the selection of these crosspoint switches so as to receive in a given direction. Thus, the satellite switching matrix serves as the gating switch for reception. In addition, transmission may be to several ground stations, and therefore the transmission matrix serves as the gating switch for transmission as well as accomplishing beam steering.

Rapid independent selection of the directions of transmission and reception make the TDMA system efficient by allowing dynamic storage of information in the space between the satellite and ground station.

This completes the description of the apparatus and preferred embodiments of the invention. However, many modifications thereof will be apparent to those skilled in the art. For example, the transmitting and receiving means can be one and the same through the use of transmit-receive switches well-known to those familiar with the art. Accordingly, it is intended that all matter contained in the foregoing description and in the accompanying drawings shall be interpreted as illustrative and not in a limiting sense.

The embodiments of the invention in which an exclusive property or privilege is claimed are defined as follows:

1. Apparatus for supplying phase-shifted electrical signals to a plurality of radiating elements of an array antenna, comprising:

an optical modulator responsive to an input electrical signal to provide an intensity modulated optical signal;

optical phase shift means for receiving said modulated optical signal, and for providing a plurality of discrete, phase-shifted, signals on a plurality of outputs, each said output providing a respective one of said discrete, phase-shifted, signals; and a switching matrix having columns each adapted to be electrically connected to a respective one of said radiating elements, and rows each optically coupled to one of said phase shift means outputs, a plurality of opto-electric switches located at the intersections of the rows and columns, each switch adapted to provide to the associated column a phase-shifted electrical signal corresponding to the phase-shifted signal received on the associated row, whereby the plurality of radiating elements are selectively energized by the plurality of phase-shifted electrical signals provided from said columns.

2. Apparatus as in claim 1 wherein each said opto-electric switch includes a photo-diode, enabled when reverse biased.

3. Apparatus as in claim 1 wherein each said opto-electric switch includes a photoconductive detector, enabled by applying a drain voltage.

4. Apparatus as in claim 1 wherein said phase shift means includes a plurality of optical fibers.

5. Apparatus as in claim 1 wherein said phase shift means includes a plurality of electrical delay lines.

6. Apparatus for supplying phase-shifted components of an input electrical signal to a plurality of radiating elements of an array antenna, comprising:

a plurality of delay lines connected to receive said electrical signal, for providing a plurality of discrete, phase-shifted electrical signals on a plurality of outputs, each output providing a respective one of said discrete, phase-shifted electrical signals;

a plurality of optical-modulators each positioned at a respective output of said delay lines and responsive to the electrical signal to provide an intensity modulated, phase-shifted optical signal; and a switching matrix having columns each adapted to be electrically connected to a respective one of said radiating elements, and rows each optically coupled to one of said optical modulators, a plurality of opto-electric switches located at the intersections of the rows and columns, each switch adapted to provide to the associated column an electrical signal corresponding to the phase-shifted optical signal received on the associated row, whereby the plurality of radiating elements are selectively energized by the plurality of electrical signals provided from said columns.

7. Apparatus according to claim 6 wherein each said opto-electric switch includes a photo-diode, enabled when reverse biased.

8. Apparatus according to claim 6 wherein each said opto-electrical switch includes a photo-conductive detector, enabled by applying a drain voltage.

9. Apparatus according to claim 6 wherein said plurality of delay lines includes a plurality of optical fibers.

10. Apparatus according to claim 6 wherein said plurality of delay lines includes a plurality of electrical delay lines.

11. Apparatus to control direction of transmission of an antenna array having first and second pluralities of radiating elements, comprising:

a plurality of delay lines adapted to receive a carrier signal;

a matrix of opto-electric transducers;

means coupling said delay lines to said matrix from which a set of phase-shifted components of the carrier signal is obtained;

a first plurality of mixers each one adapted to be coupled to a respective one of said first plurality of radiating elements of the antenna array;

means supplying said set of phase-shifted components to said first mixers together with a transmitter signal;

means adapted to connect the outputs of said first mixers to respective ones of said first plurality of individual antenna elements in said array whereby a direction of transmission is selected by energizing selected opto-electric transducers in said array;

means, coupled to said second plurality of individual antenna elements, for providing a plurality of received signals;

a second plurality of mixers receiving the set of phase-shifted components and mixing them with said plurality of received signals;

summing means connected to said second plurality of mixers, for summing the mixed received signals to provide an output signal indicative of the direction of transmission.

12. Apparatus to control the radiating direction of an antenna array having a plurality of individual antenna elements, comprising:

a first plurality of delay lines adapted to receive a transmitter signal;

a first matrix of opto-electric transducers;

means coupling said first plurality of delay lines to said matrix from which a set of phase-shifted components of the transmitter signal is obtained;

a first plurality of mixers each adapted to be coupled to a respective one of a first plurality of antenna elements of the antenna array;

means for supplying said set of phase-shifted components to said first plurality of mixers together with a first carrier frequency;

means connecting each of said first plurality of mixers to respective ones of said first plurality of individual antenna elements whereby a direction of transmission is selected by energizing selected opto-electric transducers in said array;

a second plurality of delay lines;

a second plurality of mixers each receiving a second carrier frequency and adapted to be coupled to a respective one of a second plurality of individual antenna elements;

a second matrix of opto-electrical elements;

means for coupling said second plurality of mixers to said second matrix, said second matrix being coupled to said second plurality of delay lines and providing a set of phase-shifted components of signals received by said second plurality of individual antenna elements; and a summing circuit connected to said second plurality of delay lines to provide an output signal having an effective direction of reception which can be controlled independently of the direction of transmission.

* * * * *